US006940225B2

(12) United States Patent
Araki et al.

(10) Patent No.: US 6,940,225 B2
(45) Date of Patent: Sep. 6, 2005

(54) PLASMA DISPLAY PANEL HAVING ELECTRODE WITH FIRST AND SECOND PORTIONS

(75) Inventors: Kota Araki, Tokyo (JP); Akifumi Okigawa, Tokyo (JP); Tadashi Nakamura, Tokyo (JP); Yoshito Tanaka, Tokyo (JP); Toshihiro Yoshioka, Tokyo (JP)

(73) Assignee: Pioneer Plasma Display Corporation, Kagoshima Prefecture (JP)

( * ) Notice: Subject to any disclaimer, the term of this patent is extended or adjusted under 35 U.S.C. 154(b) by 23 days.

(21) Appl. No.: 10/625,877

(22) Filed: Jul. 24, 2003

(65) Prior Publication Data

US 2004/0070340 A1 Apr. 15, 2004

(30) Foreign Application Priority Data

Jul. 24, 2002 (JP) ..... 2002-214933

(51) Int. Cl.[7] ..... H01J 17/49

(52) U.S. Cl. ..... 313/582; 313/584; 313/609; 313/631

(58) Field of Search ..... 313/582, 583, 313/584, 609, 610, 631, 491; 345/55, 60, 63

(56) References Cited

U.S. PATENT DOCUMENTS 6,486,611 B2 * 11/2002 Tokunaga et al. ..... 315/169.4
6,495,957 B2 * 12/2002 Kurogi et al. ..... 313/584
6,512,337 B2 * 1/2003 Hirano et al. ..... 315/169.4
6,646,377 B2 * 11/2003 Hashimoto ..... 313/582

FOREIGN PATENT DOCUMENTS

| | | |
|---|---|---|
| JP | 10-321142 | 12/1998 |
| JP | 2000-323045 | 11/2000 |
| JP | 2001-160361 | 6/2001 |
| JP | 2001-307646 | 11/2001 |
| JP | 2002-8549 | 1/2002 |
| JP | 2002-75219 | 3/2002 |

* cited by examiner

*Primary Examiner*—Joseph Williams
*Assistant Examiner*—Kevin Quarterman
(74) *Attorney, Agent, or Firm*—Morgan, Lewis & Bockius LLP

(57) ABSTRACT

A plasma display panel includes a first substrate, a second substrate, and discharge gas filled in a space defined between the first and second substrates, the first substrate including at least one first electrode extending in a first direction, and at least one second electrode extending in parallel with the first electrode, the second substrate including at least one third electrode extending in a second direction perpendicular to the first direction, and a plurality of partition walls extending in the second direction for partitioning a display area, wherein at least one of the first and second electrodes is comprised of a first portion being in the form of a line extending in the first direction, and defining a discharge gap between itself and an adjacent electrode, and a second portion radially extending from the first portion in a direction away from the discharge gap.

19 Claims, 13 Drawing Sheets

PLASMA DISPLAY PANEL HAVING ELECTRODE WITH FIRST AND SECOND PORTIONS

BACKGROUND OF THE INVENTION

1. Field of the Invention

The invention relates to a plasma display panel, and more particularly to an AC type plasma display panel.

2. Description of the Related Art

A plasma display panel is structurally grouped into a DC type panel in which electrodes are exposed to discharge gas and an AC type panel in which electrodes are covered with a dielectric layer, and accordingly, are not exposed to discharge gas. An AC type plasma display panel is further grouped into a memory operation type panel having a memory function caused by electric-charge accumulation function of the above-mentioned dielectric layer, and a refresh operation type panel not having such a memory function.

FIG. 1 is an exploded perspective view of a conventional plasma display panel. Hereinbelow are explained a structure of an AC type plasma display panel and a method of driving a memory function type plasma display panel.

The plasma display panel is designed to include an electrically insulating front substrate 1A and an electrically insulating rear substrate 1B.

A scanning electrode 9 and a sustaining electrode 10, spaced away from each other by a predetermined gap, are arranged on the front substrate 1A as a pair in parallel with each other. Each of the scanning and sustaining electrodes 9 and 10 is comprised of a principal electrode 2 for generating discharge and a bus electrode 3 for ensuring electrical conductivity.

The principal electrode 2 is comprised of a transparent electrode composed of ITO (indium tin oxide) or $SnO_2$ in order to prevent reduction in a light-transmission rate. The bus electrode 3 is composed of metal such as silver.

The scanning and sustaining electrodes 9 and 10 are covered with a dielectric layer 4A, and the dielectric layer 4A is covered with a protection film 5 composed of magnesium oxide for protecting the dielectric layer 4A from discharge.

A plurality of data electrodes 6 is arranged on the rear substrate 1B such that the data electrodes 6 extend in a direction perpendicular to a direction in which the scanning and sustaining electrodes 9 and 10 extend.

The data electrodes 6 are covered with a dielectric layer 4B. On the dielectric layer 4B is formed a plurality of partition walls 7 each extending in a column direction and defining discharge spaces and cells.

Phosphor 8 is coated on an exposed surface of the dielectric layer 4B and sidewalls of the partition walls 7. The phosphor 8 converts ultra-violet rays generated by discharge, into a visible light. By coating red, green and blue phosphors in every three cells, it would be possible to display images with colors.

The front and rear substrates 1A and 1B are adhered to each other in hermetically sealed condition such that the protection film 5 and the phosphor 8 face each other. Discharge gas composed of helium, neon or xenon solely or in combination is introduced into spaces sandwiched defined by the front and rear substrates 1*a* and 1*b* and the partition walls 7.

FIG. 2A is a plan view of the plasma display panel illustrated in FIG. 1, as viewed from a viewer.

The scanning and sustaining electrodes 9 and 10 extend in a row direction in parallel with each other as a pair. A gap formed between the scanning and sustaining electrodes 9 and 10 defines a discharge gap, in which surface discharge is generated between the scanning and sustaining electrodes 9 and 10.

Hereinbelow is explained generation of discharge in a selected display cell.

By applying a pulse voltage across the scanning and data electrodes 9 and 6 in each of display cells over a discharge threshold, discharge is generated between the scanning and data electrodes 9 and 6. As a result, positive and negative electric charges are attracted to and accumulated on surfaces of the dielectric layers 4A and 4B in accordance with polarity of the pulse voltage.

A wall voltage defined as an equivalent internal voltage caused by accumulation of the electric charges has opposite polarity to a polarity of the pulse voltage. Hence, as the discharge grows, an effective voltage in a display cell lowers, resulting in that even if the pulse voltage is kept at a fixed voltage, the discharge cannot be maintained, and finally, stops.

If a voltage equal to or greater than a predetermined voltage is applied across the scanning and sustaining electrodes 9 and 10 when discharge is generated between the scanning and data electrodes 9 and 6, there is further generated discharge between the scanning and sustaining electrodes 9 and 10 with the former discharge acting as a trigger. As a result, similarly to the discharge generated between the scanning and data electrodes 9 and 6, electric charges are accumulated on the dielectric layer 4A such that the voltage applied is cancelled.

Then, a sustaining discharge pulse defined as a pulse voltage having the same polarity as that of the wall voltage is applied across the scanning and sustaining electrodes 9 and 10. Since the wall voltage is added as an effective voltage to the sustaining discharge pulse, even if the sustaining discharge pulse has a small voltage-amplitude, a sum of the wall voltage and the sustaining discharge pulse is over a discharge threshold, and hence, there is generated discharge. Accordingly, the discharge can be maintained by alternately applying the sustaining discharge pulse across the scanning and sustaining electrodes 9 and 10. This is called a memory function.

FIG. 3 illustrates waveforms of voltages to be applied to electrodes in a conventional method of driving a plasma display panel. Hereinbelow is explained a method of driving a memory function and AC type plasma display panel, with reference to FIG. 3.

In FIG. 3, "Si" indicates a waveform of a voltage to be applied to scanning electrode 9 scanned at an i-th order, "C" indicates a waveform of a voltage to be applied to the sustaining electrode 10, and "D" indicates a waveform of a voltage to be applied to the data electrode 6.

As illustrated in FIG. 3, one period of driving a plasma display panel is comprised of an initialization period in which a display cell is initialized for readily generating discharge, a scanning period in which a cell or cells from which a light is emitted is(are) selected, and a sustaining period in which a light is emitted in a cell or cells having been selected in the scanning period.

In the initialization period, an erasion pulse P1 is applied to all of the scanning electrode 9 for generating erasion discharge for erasing wall electric charges accumulated on the dielectric layers 4A and 4B by the previous sustaining discharge pulses.

Herein, the term "erasion" or "erasing" is not to be limited to erasion of all of wall electric charges, but should be interpreted to include adjustment of wall electric charges for smoothly carrying out subsequent preliminary discharge, writing discharge and sustaining discharge.

Then, a preliminary discharge pulse P2 is applied to all of the scanning electrodes 9 for compulsorily generating discharge in all of display cells for light emission. Then, a preliminary discharge erasing pulse P3 is applied to all of the scanning electrode 9 for generating erasing discharge to erase wall electric charges generated by the preliminary discharge pulse P2.

The term "erase" is not to be limited to erasion of all of wall electric charges, but should be interpreted to include adjustment of wall electric charges for smoothly carrying out subsequent writing discharge and sustaining discharge. Subsequent writing discharge can be readily generated by virtue of the preliminary discharge and the preliminary discharge erasion.

The preliminary discharge pulse P2 and the preliminary discharge erasing pulse P3 both illustrated in FIG. 3 are serrate pulses in which a voltage is increased with the lapse of time. The serrate pulse generates weak discharge expanding only around the discharge gap.

The preliminary discharge and the discharge for erasing the preliminary discharge are generated independently of images. Hence, light emission caused by these discharges is observed as a background luminance. If such a background luminance is high, contrast would be deteriorated, and image quality is degraded.

In the scanning period, a scanning pulse P4 is applied to each one of the scanning electrodes 9 at different timings, and a data pulse P5 is applied to the data electrodes 6 in accordance with displayed data at a timing at which the scanning pulse P4 was applied to the scanning electrode 9.

In a cell in which the data pulse P5 is applied to the data electrode 6 when the scanning pulse P4 was applied to the scanning electrode 9, discharge is generated between the scanning and data electrodes 9 and 6, and then, the discharge triggers another discharge between the scanning and sustaining electrodes 9 and 10.

A series of the above-mentioned steps is called writing discharge. As a result of generation of the writing discharge, positive electric charges are accumulated on the dielectric layer 4A above the scanning electrodes 9, negative electric charges are accumulated on the dielectric layer 4A above the sustaining electrodes 10, and negative electric charges are accumulated on the dielectric layer 4B above the data electrodes 6.

In the sustaining period, there is generated surface discharge between the scanning and sustaining electrodes 9 and 10, if a voltage caused by electric charges accumulated on the dielectric layer 4*a* due to the writing discharge having been generated in the scanning period is added to a sustaining voltage.

The sustaining voltage is designed to be a voltage smaller than a voltage at which the surface discharge is generated. Hence, if the writing discharge was not generated in the scanning period, and hence, wall electric charges were not accumulated on the dielectric layer 4A, sustaining discharge is generated for displaying images only in a cell having been selected in the scanning period.

After generation of the first sustaining discharge, negative electric charges are accumulated on the dielectric layer 4A above the scanning electrodes 9, and positive electric charges are accumulated on the dielectric layer 4A above the sustaining electrodes 10.

The second sustaining pulse has a polarity opposite to that of the first sustaining pulse to be applied to the scanning and sustaining electrodes 9 and 10. Hence, a voltage caused by electric charges accumulated on the dielectric layer 4A is added to the second sustaining pulse, and resultingly, there is generated second discharge. Thereafter, sustaining discharge is kept generated in the same way.

If the surface discharge is not generated by the first sustaining pulse, there is not generated discharge by subsequent sustaining pulses.

A combination of the above-mentioned initialization period, scanning period and sustaining period is called a sub-field. Images are displayed by turning on or off each of a plurality of sub-fields.

In the above-mentioned method of driving a plasma display panel, a luminance of a plasma display panel is defined as a product of a light-emission luminance per a sustaining pulse and the number of sustaining light emission, and consumed power is defined as a product of a voltage of a sustaining pulse and a current.

However, the conventional plasma display panel is accompanied with high power consumption. For instance, a 42-size plasma display panel consumes about 150 to 200 W for generating sustaining discharges. Thus, it is desired that a current is reduced for reducing power consumption.

FIG. 2A illustrates a shape of the principal discharge electrode 2, and FIG. 2B illustrates an area 17 in which weak discharge expands.

If the principal discharge electrode 2 has such a shape as illustrated in FIG. 2A, a current is consumed much relative to a light-emission luminance, resulting in a problem of a poor light-emission efficiency.

If discharge is generated in the vicinity of the partition walls 7, electric charges generated in the discharge are likely to be attracted to the partition walls 7, resulting in reduction in ultra-violet rays. That is, a current is not effectively consumed with the result of a problem of deterioration in a light-emission efficiency.

FIG. 4A is an upper plan view of another principal discharge electrode 2, and FIG. 4B shows an area 16 in which strong discharge expands.

The illustrated principal discharge electrode 2 is designed to be rectangular and exist only in a display area, unlike the principal discharge electrode 2 illustrated in FIG. 1 which extends in the row direction. The rectangular principal discharge electrode 2 illustrated in FIG. 4A prevents generation of discharge in the vicinity of the partition walls 7, and further prevents electric charges from being attracted to the partition walls 7. Hence, the rectangular principal discharge electrode 2 illustrated in FIG. 4A presents a slightly higher light-emission efficiency than that of the principal discharge electrode 2 illustrated in FIG. 2A.

However, a light-emission efficiency presented by the rectangular principal discharge electrode 2 illustrated in FIG. 4A is not sufficient. This is because the principal discharge electrode 2 covers a display area almost entirely therewith, and hence, discharge is generated over entirety of the principal discharge electrode 2 and hence entirety of a display area.

Ultra-violet rays are also generated in an area in which discharge is generated. If some time has passed after generation of ultra-violet rays, ultra-violet rays are absorbed into surrounding discharge gas, resulting in that ultra-violet rays cannot reach the phosphor 8. Accordingly, ultra-violet rays are not converted into a visible light, unless the ultra-violet rays are generated in the vicinity of the partition walls 7 on which the phosphor 8 is coated.

The principal discharge electrodes 2 over which discharge and ultra-violet rays are generated, illustrated in FIGS. 2A and 4A, are accompanied with a problem that much ultra-violet rays are not converted into a visible light with the result of reduction in a light-emission efficiency.

FIG. 5 is a plan view of a principal discharge electrode suggested in Japanese Patent Application Publication No. 2001-160361.

As illustrated in FIG. 5, the suggested principal discharge electrode 2 is comprised of a first linear portion defining a discharge gap, and two second linear portions extending from opposite ends of the first linear portion along a partition wall 7. The suggested principal discharge electrode 2 is accompanied with a problem that it is difficult for strong discharge generated at the center of the first linear portion to expand towards distal ends of the second linear portions. As a result, a plasma display panel cannot operate stably and a luminance is low in comparison with the principal discharge electrode illustrated in FIG. 4A.

FIG. 6 is a plan view of another principal discharge electrode suggested in Japanese Patent Application Publication No. 2001-160361.

As illustrated in FIG. 6, the suggested principal discharge electrode 2 is comprised of a first linear portion defining a discharge gap, and two second linear portions radially extending from opposite ends of the first linear portion. The first linear portion is designed shorter than the first linear portion illustrated in FIG. 5. This results in that a voltage at which discharge is generated becomes higher than the same in FIG. 5. In addition, since strong discharge generated at the center of the first linear portion does not expand to the partition wall 7 along the discharge gap, a luminance is unavoidably reduced.

Japanese Patent Application Publication No. 10-321142 has suggested a plasma display panel including sustaining electrodes each comprised of a transparent electrode having a high rate at which a visible light passes therethrough, and a mother electrode composed of a low-resistive metal and extend in parallel with the transparent electrode. The transparent electrode and the mother electrode are electrically connected to each other through a short-circuit electrode which overlaps a rib extending in a direction perpendicular to a direction in which the sustaining electrodes extend.

Japanese Patent Application Publication No. 2000-323045 has suggested a plasma display panel including principal electrodes each having a bus in the form of a strip and extending in a row direction, and gap-forming portions extending from the bus in a column direction.

Japanese Patent Application Publication No. 2001-307646 has suggested a gas discharge panel including a pair of display electrodes each comprised of a bus line extending in a row direction, and a plurality of extensions extending towards an opposing display electrode. The extensions extending from the display electrodes are alternately arranged.

Japanese Patent Application Publication No. 2002-8549 has suggested a plasma display panel including sustaining electrodes each formed with a plurality of openings arranged in a matrix. The openings are in the form of a rectangle having a side smaller than 30 micrometers.

Japanese Patent Application Publication No. 2002-75219 has suggested a plasma display panel including a bus electrode having a portion extending towards two light-emission areas located adjacent to each other such that the portion is electrically connected to a transparent electrode.

SUMMARY OF THE INVENTION

In view of the above-mentioned problems in the conventional plasma display panels, it is an object of the present invention to provide a plasma display panel which is capable of accomplishing a high luminance, presenting a high light-emission efficiency, and stably operating.

In one aspect of the present invention, there is provided a plasma display panel including a first substrate, a second substrate, and discharge gas filled in a space defined between the first and second substrates, the first substrate including at least one first electrode extending in a first direction, and at least one second electrode extending in parallel with the first electrode, the second substrate including at least one third electrode extending in a second direction perpendicular to the first direction, and a plurality of partition walls extending in the second direction for partitioning a display area, wherein at least one of the first and second electrodes is comprised of a first portion being in the form of a line extending in the first direction, and defining a discharge gap between itself and an adjacent electrode, and a second portion radially extending from the first portion in a direction away from the discharge gap.

For instance, the second portion radially may extend from the first portion at a center of the display area in the first direction.

For instance, the second portion may be comprised of a straight line.

For instance, the second portion may be comprised of a line including curved portions.

For instance, the second portion may include a portion extending in the second direction.

It is preferable that the first portion has a length measured in the first direction which length is equal to or greater than 2W wherein W indicates a width of the discharge gap.

It is preferable that the first portion has a length measured in the second direction which length is in the range of 0.5W and 3W both inclusive wherein W indicates a width of the discharge gap.

For instance, each of the first and second electrodes may be comprised of a principal discharge electrode for carrying out discharge and a bus electrode for reducing a line resistance in the first direction.

It is preferable that the principal electrode is comprised of a transparent electrode having a high rate at which visible lights pass the re through.

It is preferable that the principal electrode is comprised of a transparent electrode having a high rate at which visible lights pass therethrough, and a thin metal wire.

For instance, at least one of the first and second electrodes may be comprised of a thin metal wire.

It is preferable that the principal electrode at least partially thereof does not make contact with the bus electrode in the display area.

The plasma display panel may further include a plurality of second partition walls extending in the first direction for partitioning the display area, the first and second electrodes being arranged such that they do not extend across a boundary between the display area and the second partition walls.

It is preferable that each of the first and second electrodes is comprised of a principal discharge electrode for carrying out discharge and a bus electrode for reducing a line resistance, the bus electrode being arranged on the first partition walls such that the bus electrode is not exposed to a discharge space in the display area.

It is preferable that the second portion exists entirely in the display area.

For instance, the second portion may be V-shaped.

It is preferable that the first portion is continuous with first portions extending in adjacent display areas.

For instance, the second portion may be comprised of a V-shaped portion extending from the first portion, and two lines extending from distal ends of the V-shaped portion in the second direction.

It is preferable that the second portion is U-shaped.

It is preferable that the second portion is comprised of at least three lines extending from the first portion.

It is preferable that at least one of the lines exist within the display area.

It is preferable that the second electrode is at least partially connected to the bus electrode.

There is further provided a plasma display panel including a first substrate, a second substrate, and discharge gas filled in a space defined between the first and second substrates, the first substrate including at least one first electrode extending in a first direction, and at least one second electrode extending in parallel with the first electrode, the second substrate including at least one third electrode extending in a second direction perpendicular to the first direction, and a plurality of partition walls extending in the second direction for partitioning a display area, each of the first and second electrodes being comprised of a principal discharge electrode for carrying out discharge and a bus electrode for reducing a line resistance, the bus electrode being arranged on the first partition walls such that the bus electrode is not exposed to a discharge space in the display area, wherein the principal discharge electrode in at least one of the first and second electrodes is comprised of a first portion being in the form of a line extending in the first direction, and defining a discharge gap between itself and an adjacent electrode, and a second portion comprised of a first section spaced away from the first portion and making electrical contact with the bus electrode, and a second section electrically connecting the first portion and the bus electrode to each other.

For instance, the first section may be reverse-U-shaped.

It is preferable that the second section extends in the second direction above the partition walls.

It is preferable that a minimum gap between the first and second portions is equal to or smaller than 2W wherein W indicates a width of the display area.

The plasma display panel may further include a third portion which connects the first and second portions to each other, in which case, it is preferable that the second portion exists entirely within the display area.

There is still further provided a plasma display panel including a first substrate, a second substrate, and discharge gas filled in a space defined between the first and second substrates, the first substrate including at least one first electrode extending in a first direction, and at least one second electrode extending in parallel with the first electrode, the second substrate including at least one third electrode extending in a second direction perpendicular to the first direction, a plurality of first partition walls extending in the first direction, and a plurality of second partition walls extending in the second direction such that the first and second partition walls extend in a matrix, wherein the first and second electrodes are arranged such that they do not extend across a boundary between the display area and the first partition walls.

It is preferable that each of the first and second electrodes is comprised of a principal discharge electrode for carrying out discharge and a bus electrode for reducing a line resistance, the bus electrode being arranged on the first partition walls such that the bus electrode is not exposed to a discharge space in the display area.

The advantages obtained by the aforementioned present invention will be described hereinbelow.

In accordance with the present invention, it is possible to stably start generation of discharges.

In addition, it is possible to arrange an area in which ultra-violet rays are generated, in the vicinity of the partition walls. This ensures that discharges which generate ultra-violet rays not converted into a visible light can be reduced. As a result, it is possible to reduce a light-emission current and enhance a light-emission efficiency with prevention of a light-emission luminance from being reduced.

By spacing the first and second portions from each other, it would be possible to further reduce a background luminance.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

[First Embodiment]

Figure 7:
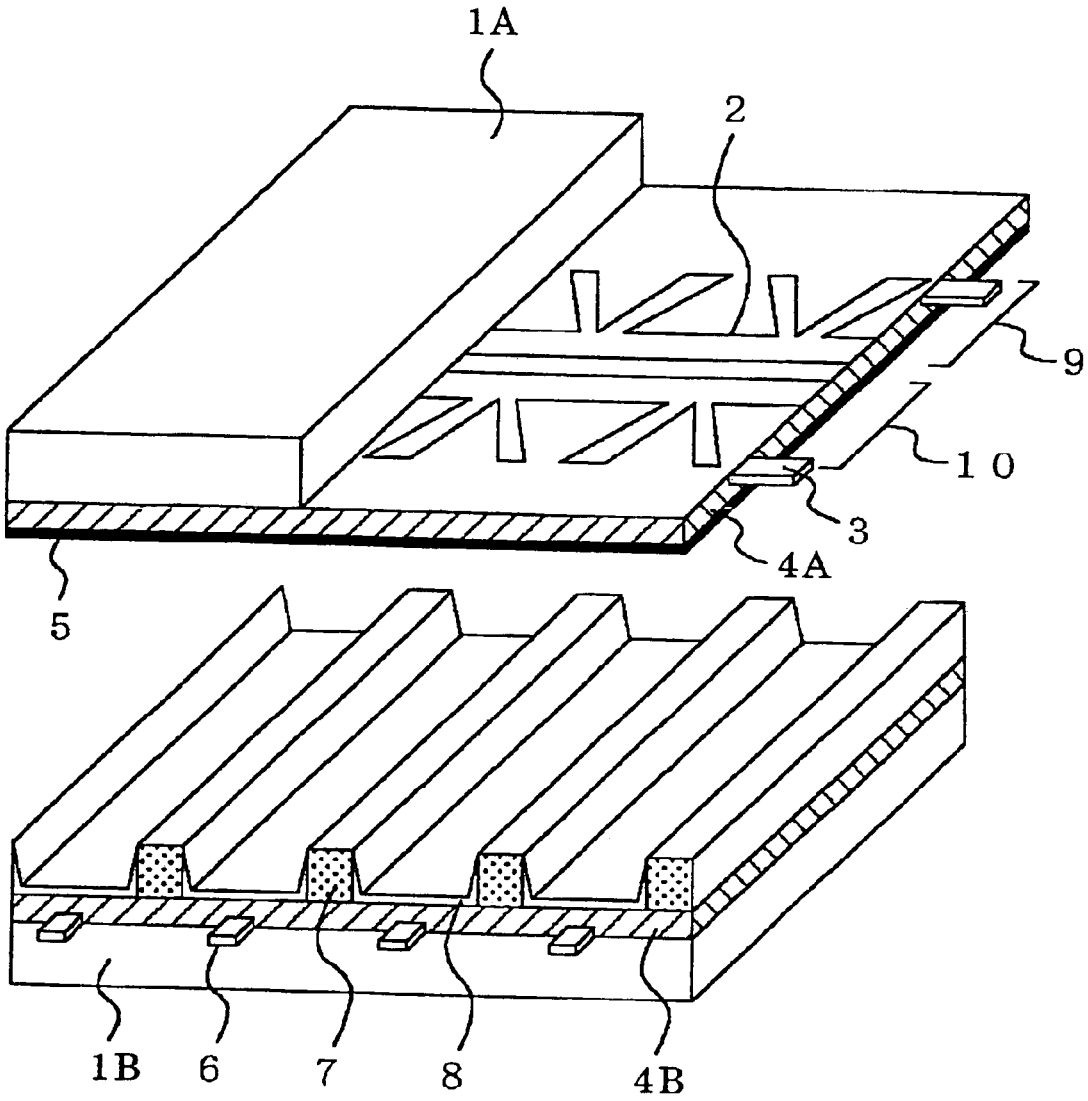
FIG. 7 is an exploded perspective view of a plasma display panel in accordance with the first embodiment of the present invention.
Figure 8:
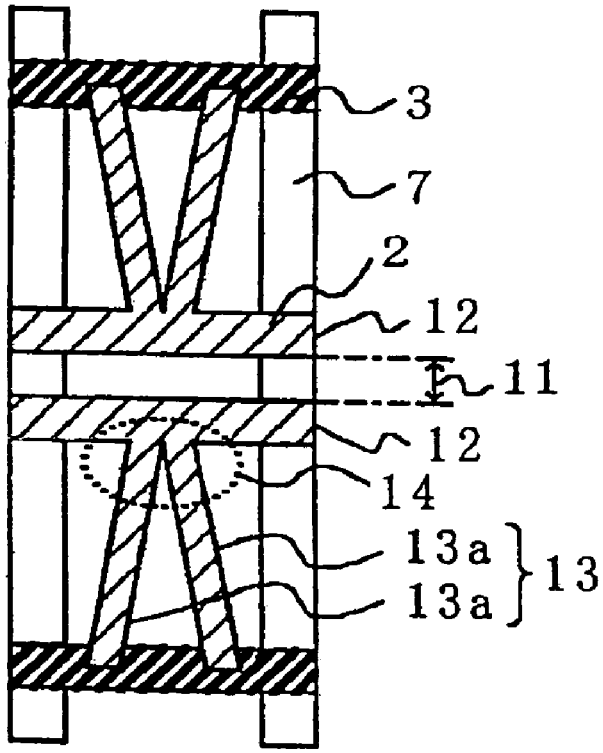
FIG. 8 is a plan view of the plasma display panel in accordance with the first embodiment.

FIG. 7 is an exploded perspective view of a plasma display panel in accordance with the first embodiment, and FIG. 8 is a plan view of the plasma display panel.

Figure 1:
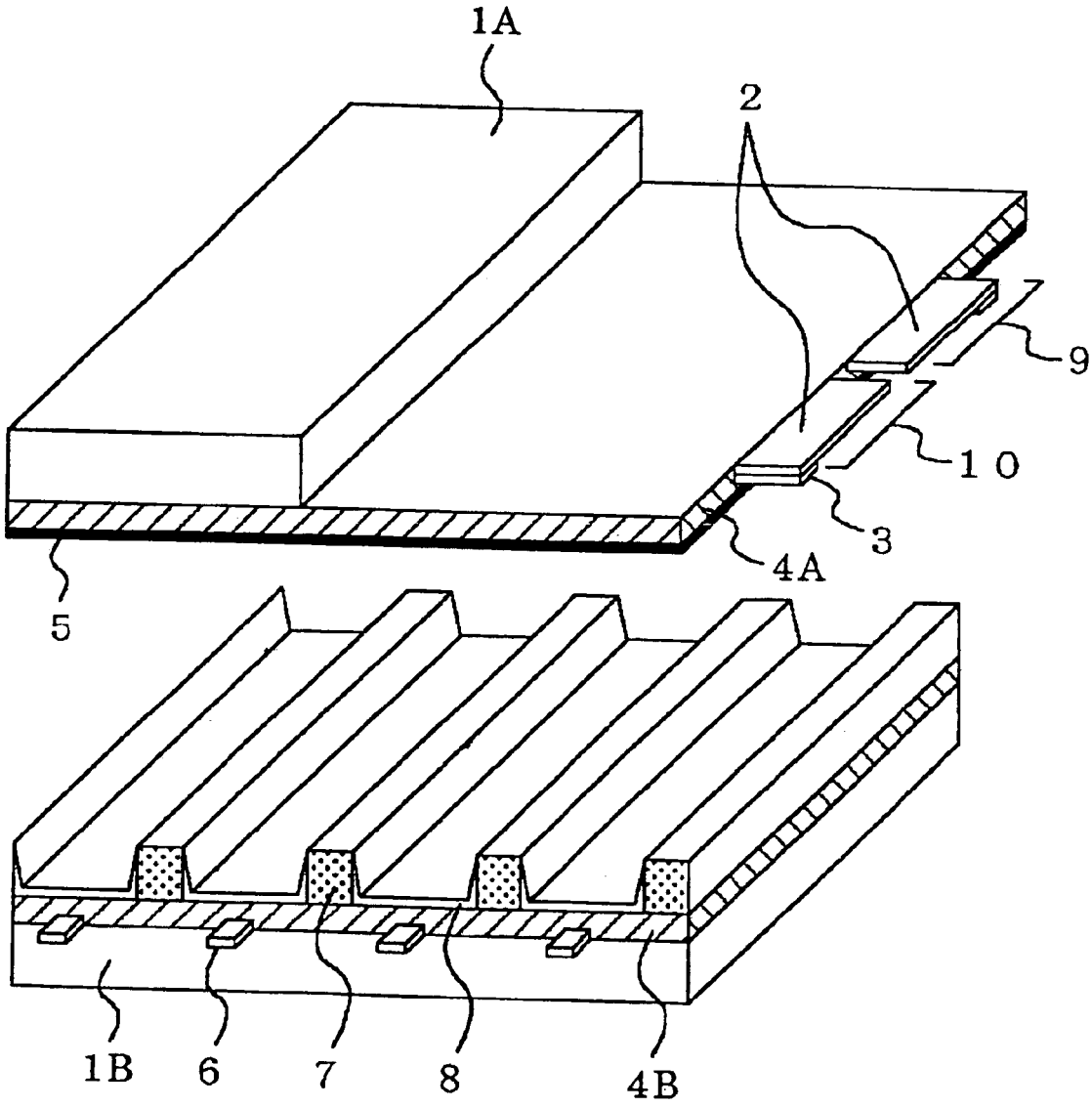
FIG.1 PRIOR ART
FIG. 1 is an exploded perspective view of a conventional plasma display panel.

The plasma display panel in accordance with the first embodiment has the same structure as that of the conventional plasma display panel illustrated in FIG. 1 except the principal discharge electrodes 2.

As illustrated in FIG. 8, the principal discharge electrodes 2 in the first embodiment is comprised of a first portion 12 being in the form of a line extending in a row direction (left-right direction in FIG. 8), and defining a discharge gap 11 between itself and an adjacent principal discharge electrode, and a second portion 13 radially extending from the first portion 12 in a direction away from the discharge gap 11, namely, a direction towards the bus electrode 3.

The discharge gap 11 is defined as a gap sandwiched between the first portion 12 of the scanning electrode 9 and the first portion 12 of the sustaining electrode 10. The discharge gap 11 is constant in a display area. In other words, the scanning and sustaining electrodes 9 and 10 are spaced away from each other by a constant distance in the row direction within a display area. The first portion 12 has a length measured in a column direction (up-down direction in FIG. 8) which length is equal to a width of the discharge gap 11.

The second portion 13 is comprised of two lines 13*a* radially extending towards the bus electrode 3. A gap between the two lines 13*a* in the row direction is greater in a position closer to the bus electrode 3. That is, the two lines 13*a* are V-shaped.

Figure 3:
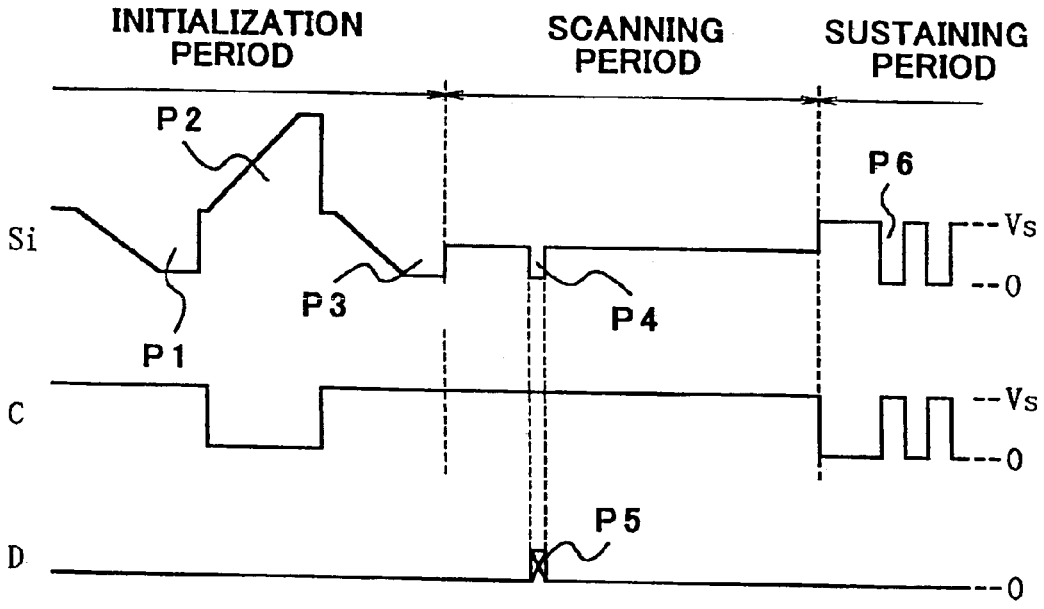
FIG.3 PRIOR ART
FIG. 3 illustrates waveforms of voltages to be applied to electrodes in a conventional method of driving a plasma display panel.

The plasma display panel in accordance with the first embodiment is driven in accordance with the same method as the conventional method having been explained with reference to FIG. 3.

Figure 4A:
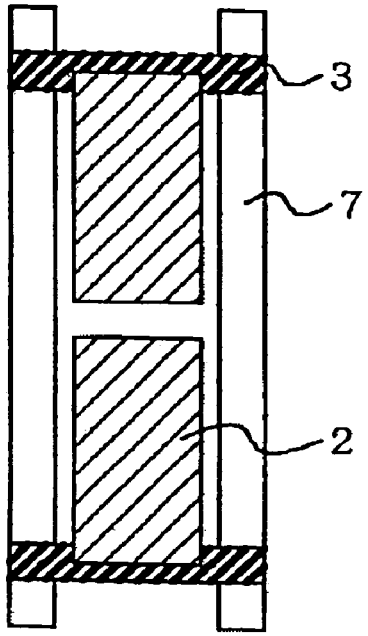
FIG.4A PRIOR ART
FIG. 4A is a plan view of another conventional plasma display panel.
Figure 4B:
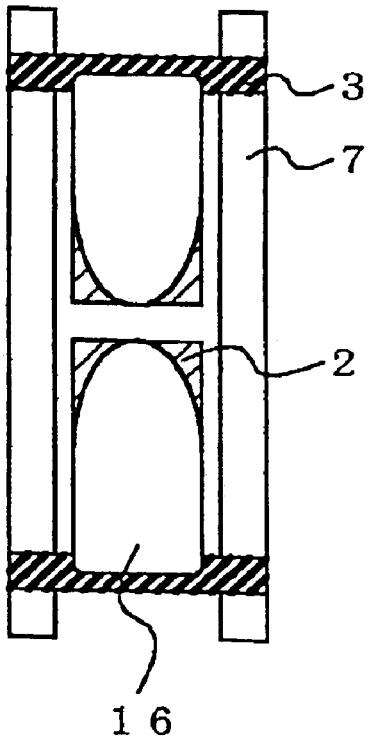
FIG.4B PRIOR ART
FIG. 4B illustrates expansion of strong discharge on principal discharge electrodes in the conventional plasma display panel illustrated in FIG. 4A.

The plasma display panel in accordance with the first embodiment can enhance a light-emission efficiency in comparison with the conventional plasma display panel illustrated in FIG. 1 and a conventional plasma display panel having the principal discharge electrode 2 illustrated in FIG. 4A.

This is because the first embodiment reduces discharges in an area 14 from which the two lines 13*a* defining the second portion 13 radially extend and from which ultra-violet rays are difficult to reach the phosphor 8.

That is, by designing the principal discharge electrode 2 to have the second portion 13 comprised of the two lines 13*a* radially extending from the first portion 12, it is possible to limit an area in which strong discharge is generated, to the area 14 located at the center of the first portion 12, and expand discharge not only in the row direction, but also in the column direction through the two lines 13*a* defining the second portion 13. As a result, an area in which discharge is generated can be formed in the vicinity of the partition walls 7, ensuring that a rate at which ultra-violet rays are converted into a visible light is increased.

In accordance with the first embodiment, ultra-violet rays are generated in the vicinity of the partition walls 7 and converted into a visible light. Hence, it is possible to suppress generation of excessive discharge without reduction in a luminance, and hence, it is possible to reduce a current to be consumed for generating discharges.

In addition, the principal discharge electrode 2 in the first embodiment ensures that discharge can be stably generated, and discharge can be expanded to distal ends of the second portion 13 in the column direction, even if a voltage at which discharge is generated is low. The reasons are explained hereinbelow.

Discharge to be generated between the scanning and sustaining electrodes 9 and 10 is born at the discharge gap 11. Discharge can be stably born by keeping the discharge gap 11 at a constant and designing the discharge gap 11 to be long in the row direction.

Furthermore, sustaining discharge can be generated at a voltage identical to a voltage at which sustaining discharge is generated through the use of the principal discharge electrode 2 illustrated in FIG. 4A.

If the first portion 12 were formed to have a too small width, a voltage at which sustaining discharge is generated would be raised. In accordance with the results of the experiments the inventors conducted, if the first portion 12 had a width equal to or greater than 0.5W wherein W indicates a width of the discharge gap 11, discharge could be stably generated.

In contrast, if the first portion 12 were formed to have a too great width, discharge would expand too much, resulting in that some of ultra-violet rays are not converted into a visible light. In accordance with the results of the experiments the inventors conducted, if the first portion 12 had a width equal to or smaller than 3W, a light-emission efficiency was not dropped so much.

Figure 9:
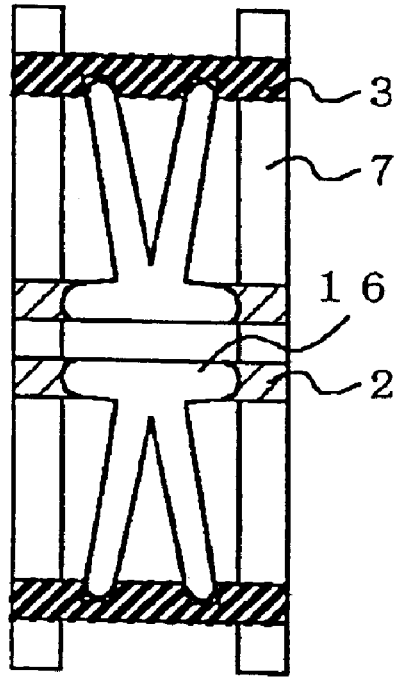
FIG. 9 illustrates expansion of strong discharge on principal discharge electrodes in the plasma display panel illustrated in FIGS. 7 and 8.

Discharge has a greatest intensity in the area 14, that is, a central area of the first portion 12. Discharge has a tendency of expanding along an electrode. Hence, as illustrated in FIG. 9, an area 16 in which strong discharge is generated expands not only in the row direction of the discharge gap 11, but also in the column direction along the two lines 13*a* defining the second portion 13.

Figure 5:
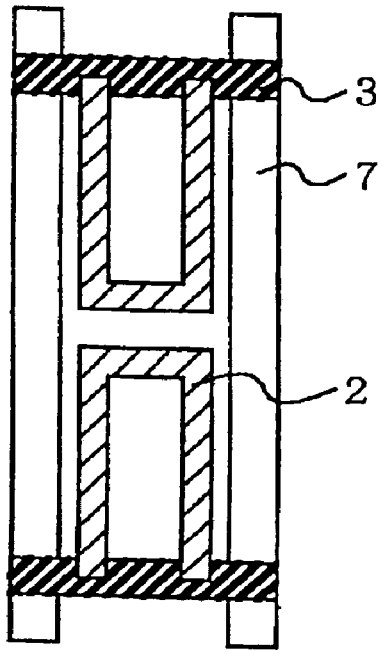
FIG.5 PRIOR ART
FIG. 5 is a plan view of still another conventional plasma display panel.
Figure 6:
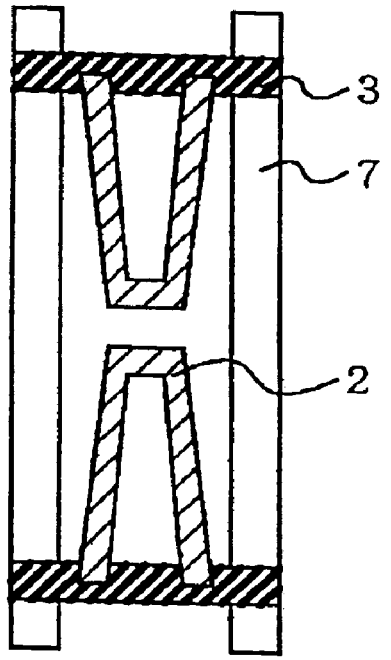
FIG.6 PRIOR ART
FIG. 6 is a plan view of yet another conventional plasma display panel.

As mentioned earlier, the conventional principal discharge electrode 2 illustrated in FIG. 5 is accompanied with a problem that it is difficult for strong discharge to expand in the column direction.

In contrast, the principal discharge electrode 2 in the first embodiment is designed to include the second portion 13 having the two lines 13*a* radially extending from the first portion 12 towards the bus electrode 3, and hence, strong discharge continuously expands from a center of the first portion 12 towards the bus electrode 3 in the column direction.

In addition, since the two lines 13*a* defining the second portion 13 expands further in the row direction, discharge expands not only in the column direction, but also in the row direction. As a result, it is possible to expand discharge in the column direction away from the first portion 12, and further towards the partition walls 7.

Since discharge expands along the second portion 13, it is possible to readily expand discharge away from the first portion 12, even if a voltage at which the discharge is generated is relatively low.

In accordance with the fist embodiment, it is possible to generate discharge with a voltage at which sustaining discharge is generated, being kept low. In addition, since discharge can be generated only in an area in which ultra-violet rays can be converted into a visible light at a high rate, a light-emission rate could be increased by about 30% in comparison with the conventional plasma display panel.

[Second Embodiment]

Figure 10:
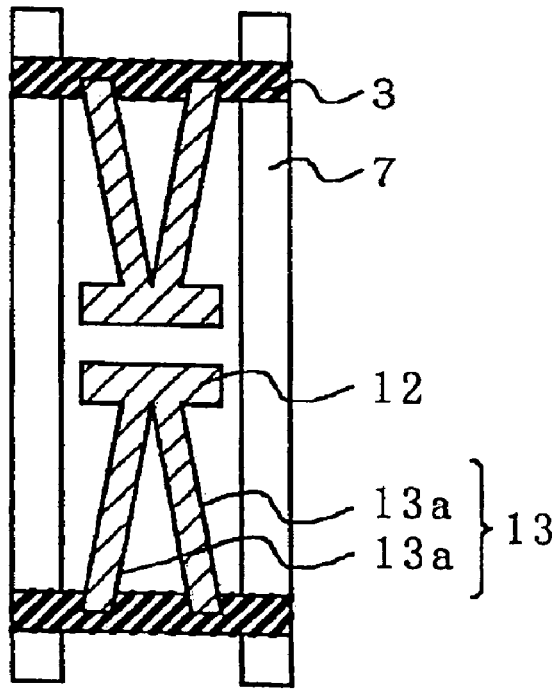
FIG. 10 is a plan view of a plasma display panel in accordance with the second embodiment of the present invention.

FIG. 10 is a plan view of principal discharge electrodes in a plasma display panel in accordance with the second embodiment.

The plasma display panel in accordance with the second embodiment is structurally different from the plasma display panel in accordance with the first embodiment only in a shape of the principal discharge electrode 2.

In the principal discharge electrode 2 in the first embodiment, illustrated in FIG. 8, the first portion 12 located in a certain display area is designed to be continuous in the row direction with the first portions 12 located in adjacent display areas. In contrast, the principal discharge electrode 2 in the second embodiment is designed not to be continuous in the row direction with the first portions 12 located in adjacent display areas. In other words, the principal discharge electrode 2 in the second embodiment is designed independent in each of display areas. The principal discharge electrode 2 in the second embodiment presents the same advantages as those presented by the principal discharge electrode 2 in the first embodiment.

If the first portion 12 were designed to have a length in the row direction which length was equal to or greater than 2W wherein W indicates a width of the discharge gap 11, discharge could be stably generated similarly to the first embodiment.

From the standpoint of discharge stability, it is better for the discharge gap 11 to have a greater width. However, if discharge is generated in the vicinity of the partition walls 7, electric charges generated in the discharge are attracted to the partition walls 7, and hence, a rate of ultra-violet rays generated in the discharge, to a consumed current is reduced. Thus, a light-emission efficiency could be enhanced, if the first portion 12 is spaced away from the partition walls 7.

[Third Embodiment]

Figure 11:
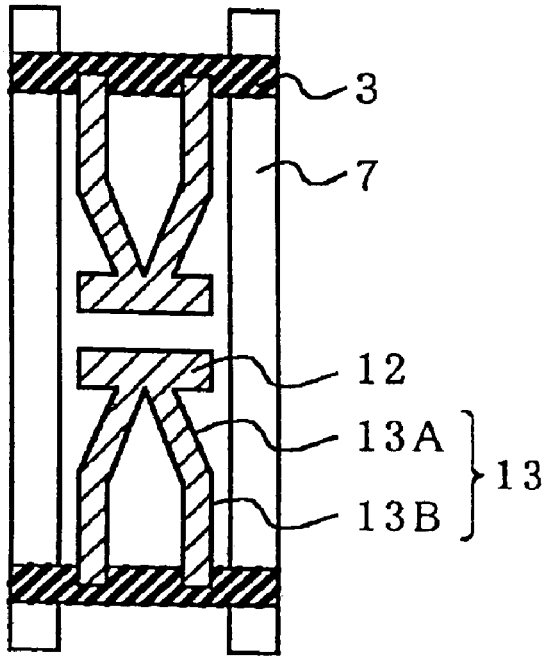
FIG. 11 is a plan view of a plasma display panel in accordance with the third embodiment of the present invention.

FIG. 11 is a plan view of principal discharge electrodes in a plasma display panel in accordance with the third embodiment.

The plasma display panel in accordance with the third embodiment is structurally different from the plasma display panel in accordance with the first embodiment only in a shape of the principal discharge electrode 2.

The principal discharge electrode 2 in the third embodiment is comprised of a first portion 12 being in the form of a line extending in the row direction and defining a discharge gap 11 between itself and an adjacent principal discharge electrode, and a second portion 13 comprised of a V-shaped portion 13A extending from the first portion 12, and two lines 13B extending from distal ends of the V-shaped portion 13A in the column direction.

The first portion 12 has a length extending in the row direction and existing only in a display area.

Similarly to the first embodiment, discharge is born at the first portion 12. Strong discharge born at the center of the first portion 12 expands along the V-shaped portion 13A and then along the two lines 13B.

The V-shaped portion 13A extends to a position in which the V-shaped portion 13A faces the partition walls 7, in a shorter distance in the row direction than the same in the two lines 13*a* of the principal discharge electrode 2 illustrated in FIG. 10, and the two lines 13B facing the partition walls 7 extend in parallel with the partition walls 7.

As a result, ultra-violet rays are much generated in the vicinity of the phosphor 8 coated on sidewalls of the partition walls 7, ensuring that ultra-violet rays are converted into a visible light at a high rate. Thus, it is possible to enhance a light-emission rate.

Figure 12:
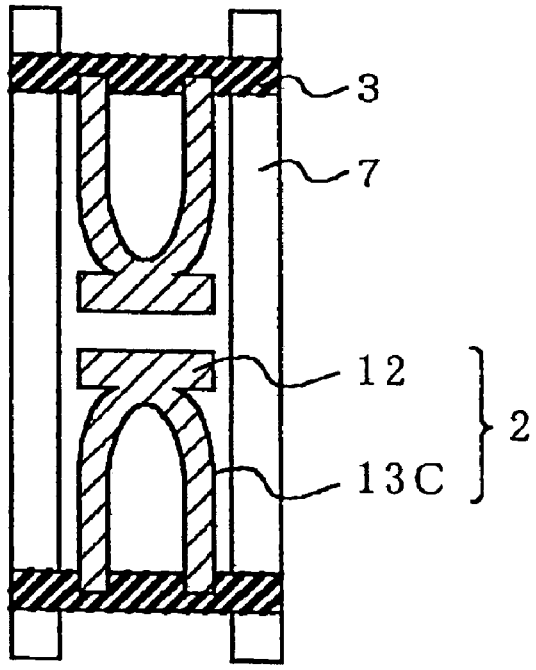
FIG. 12 is a plan view of a plasma display panel in accordance with a variant of the third embodiment of the present invention.

FIG. 12 is a plan view of a variant of the principal discharge electrodes 2 in a plasma display panel in accordance with the third embodiment.

The second portion 13C may be comprised of a line including a curve. For instance, as illustrated in FIG. 12, the second portion 13C may be reverse-U-shaped.

By designing the second portion 13C to be comprised of a line including a curve, it would be possible to continuously expand discharge in the row and column directions, and hence, discharge can be expanded towards the bus electrode 3, similarly to the principal discharge electrodes 2 illustrated in FIGS. 8, 10 and 11.

[Fourth Embodiment]

Figure 13:
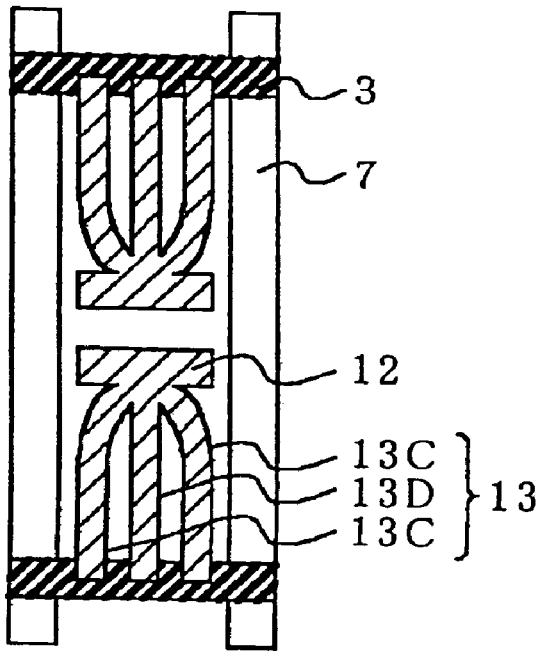
FIG. 13 is a plan view of a plasma display panel in accordance with the fourth embodiment of the present invention.

FIG. 13 is a plan view of principal discharge electrodes in a plasma display panel in accordance with the fourth embodiment.

The plasma display panel in accordance with the fourth embodiment is structurally different from the plasma display panel in accordance with the first embodiment only in a shape of the principal discharge electrode 2.

The principal discharge electrode 2 in the fourth embodiment is comprised of a first portion 12 being in the form of a line extending in the row direction and defining a discharge gap 11 between itself and an adjacent principal discharge electrode, and a second portion 13 comprised of a reverse-U-shaped portion 13C making contact at a bottom thereof with the first portion 12, and a line 13D extending from a bottom of the reverse-U-shaped portion 13C in the column direction.

Namely, the principal discharge electrode 2 in the fourth embodiment has the structure of the principal discharge electrode 2 illustrated in FIG. 12 in addition to the line 13D.

Though the line 13D is remote from the partition walls 7, the line 13D facilitates excitation of the phosphor coated on an exposed surface of the dielectric layer 4B, ensuring enhancement in a light-emission rate.

Addition of the line 13D facilitates expansion of discharge in the column direction in a display area. As a result, the plasma display panel can stable operate, even if a voltage at which the plasma display panel is driven is relatively low.

Figure 14:
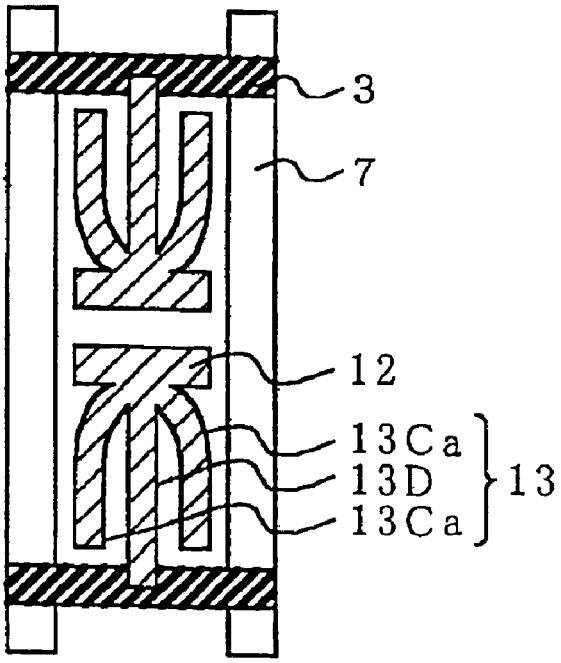
FIG. 14 is a plan view of a plasma display panel in accordance with a variant of the fourth embodiment of the present invention.

FIG. 14 is a plan view of a variant of the principal discharge electrodes 2 in a plasma display panel in accordance with the fourth embodiment.

In the principal discharge electrodes 2 illustrated in FIG. 13, the reverse-U-shaped portion 13C and the line 13D are all connected to the bus electrode 3. In contrast, a reverse-U-shaped portion 13Ca in the variant is not connected to the bus electrode 3, namely, is spaced at its distal ends away from the bus electrode 3.

When discharge expands in the column direction, discharge is generated in the vicinity of the bus electrode 3. However, a visible light generated by such discharge is partially interrupted by the bus electrode 3. Hence, in the variant, discharge to be generated in the vicinity of the bus electrode 3 is reduced, thereby a visible light interrupted by the bus electrode 3 is reduced.

It is necessary for the principal discharge electrode 2 to be at least partially connected to the bus electrode 3 in order to reduce a line resistance in the row direction. Hence, the line 13D is designed to be connected to the bus electrode 3.

[Fifth Embodiment]

Figure 15A:
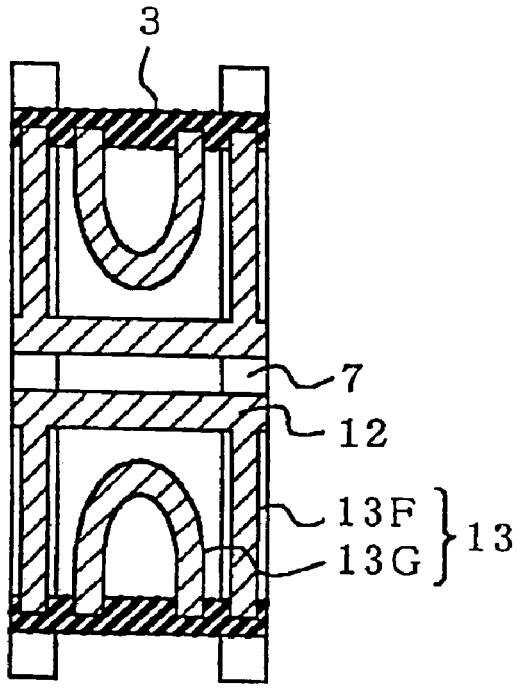
FIG. 15A is a plan view of a plasma display panel in accordance with the fifth embodiment of the present invention.
Figure 15B:
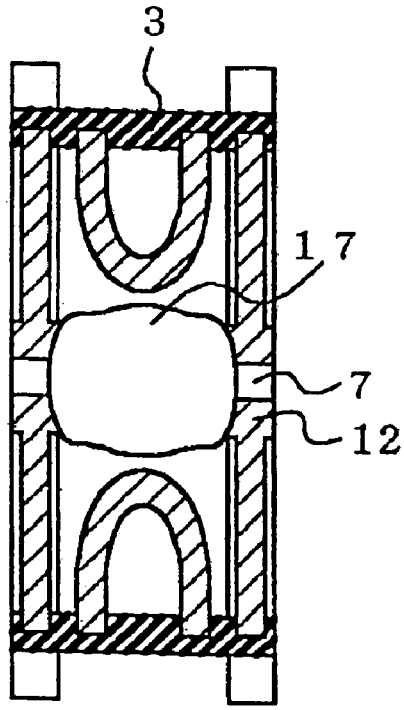
FIG. 15B illustrates expansion of weak discharge on principal discharge electrodes in the plasma display panel illustrated in FIG. 15A.

FIG. 15A is a plan view of principal discharge electrodes in a plasma display panel in accordance with the fifth embodiment, and FIG. 15B illustrates expansion of weak discharge on principal discharge electrodes illustrated in FIG. 15A.

The plasma display panel in accordance with the fifth embodiment is structurally different from the plasma display panel in accordance with the first embodiment only in a shape of the principal discharge electrode 2.

The principal discharge electrode 2 in the fifth embodiment is comprised of a first portion 12 being in the form of a line extending in the row direction and defining a discharge gap 11 between itself and an adjacent principal discharge electrode, and a second portion 13 comprised of a reverse-U-shaped portion 13G making contact at its distal ends thereof with the bus electrode 3, and an electrode 13F extending in the column direction above the partition walls and electrically connecting the first portion 12 and the bus electrode 3 to each other.

In the fifth embodiment, the second portion 13 comprised of the reverse-U-shaped portion 13G is spaced away from the first portion 12 unlike the previously mentioned embodiments.

Discharge born at a center of the first portion 12 is strongest among discharges born at the first portion 12. The strongest discharge can expand towards the second portion 13. In particular, in a pulse which rises up in a short period of time, such as sustaining discharge, a voltage over a voltage at which discharge is generated is applied to the electrodes in a short period of time. Hence, the thus generated discharge is quite strong, and accordingly, the discharge can expand in the column direction, even if the first portion 12 and the second portion 13 are spaced away from each other.

The inventors conducted the experiments to determine a maximum space between the first and second portions 12 and 13.

According to the results of the experiments, it was found that discharge could expand continuously to the second portion 13 from the first portion 12, if a space between the first and second portions 12 and 13 is equal to or smaller than 2W wherein W indicates a width of the discharge gap 11, and discharge could not expand continuously to the second portion 13 from the first portion 12, if a space between the first and second portions 12 and 13 is greater than 2W.

As mentioned above, even if the first and second portions 12 and 13 are spaced away from each other, it would be possible to expand discharge to the second portion 13 similarly to the previously mentioned embodiments.

FIG. 15B illustrates an area 17 in which weak discharge such as preliminary discharge or discharge for erasing preliminary discharge expands on the principal discharge electrodes 2 illustrated in FIG. 15A.

Figure 2A:
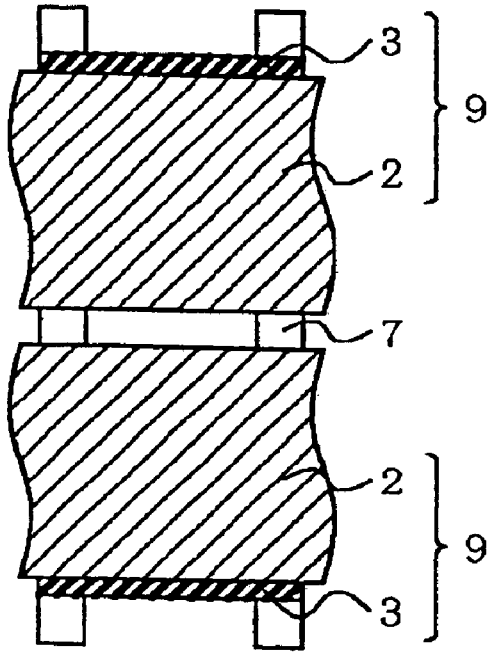
FIG.2A PRIOR ART
FIG. 2A is a plan view of the conventional plasma display panel illustrated in FIG. 1.
Figure 2B:
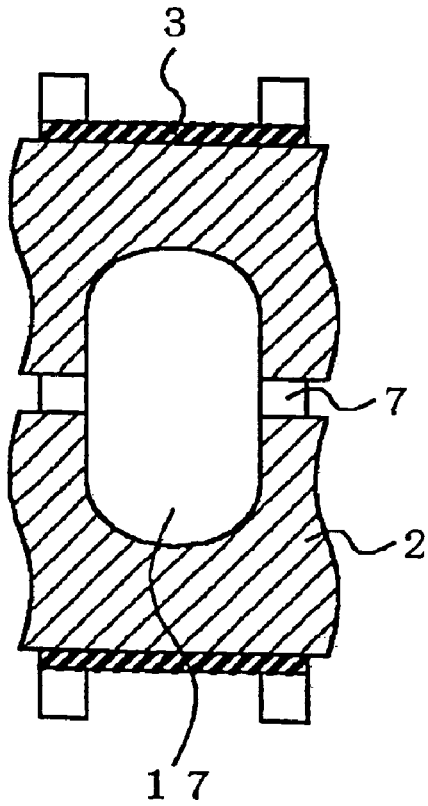
FIG.2B PRIOR ART
FIG. 2B illustrates expansion of weak discharge on principal discharge electrodes in the initialization period in the conventional plasma display panel illustrated in FIG. 1.

As mentioned earlier, the conventional principal discharge electrode illustrated in FIG. 2A is accompanied with a problem that discharge expands in the column direction, as illustrated in FIG. 2B.

In contrast, the principal discharge electrode illustrated in FIG. 15A allows discharge to expand around the first portion 12, but disallows discharge to expand to the second portion 13.

In a pulse in which a voltage is gradually increased with the lapse of time, such as preliminary discharge, discharge is gently generated when a voltage is over a threshold voltage, and slowly produces wall electric charges. The thus generated discharge has a small intensity, namely, is weak discharge.

Hence, if the first and second portions 12 and 13 are spaced away from each other, the weak discharge cannot expand beyond a space between the first and second portions 12 and 13. Accordingly, it is possible to narrow an area in which discharge such as preliminary discharge or discharge for erasing preliminary discharge expands, ensuring reduction in a background luminance.

[Sixth Embodiment]

Figure 16:
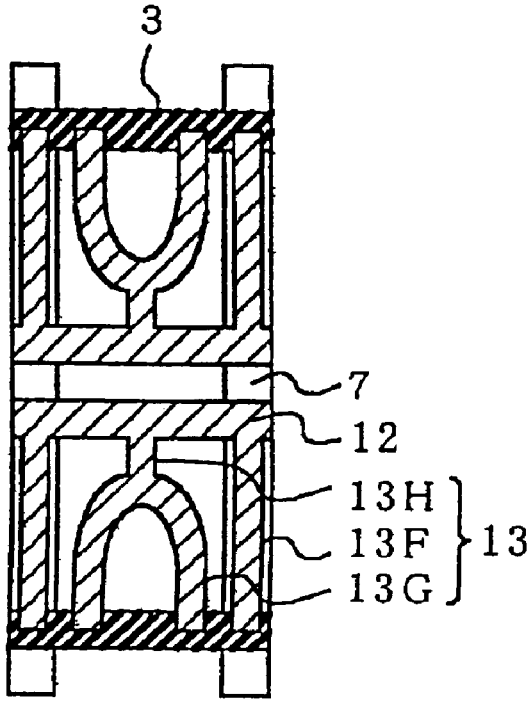
FIG. 16 is a plan view of a plasma display panel in accordance with the sixth embodiment of the present invention.

FIG. 16 is a plan view of principal discharge electrodes in a plasma display panel in accordance with the sixth embodiment.

The plasma display panel in accordance with the sixth embodiment is structurally different from the plasma display panel in accordance with the first embodiment only in a shape of the principal discharge electrode 2.

As illustrated in FIG. 16, the principal discharge electrode 2 may be designed to additionally include a third portion 13H in the form of a line extending in the column direction and connecting the first and second portions 12 and 13 to each other, in comparison with the principal discharge electrode 2 in accordance with the fifth embodiment, illustrated in FIG. 15A.

Though a background luminance is slightly higher in the sixth embodiment than in the fifth embodiment illustrated in FIG. 15A, discharge expands more stably to the second portion 13 than the fifth embodiment illustrated in FIG. 15A. In addition, since the first portion 12 is connected to the bus electrode 3 through the electrode 13F, the electrode 13F may be omitted.

Figure 17:
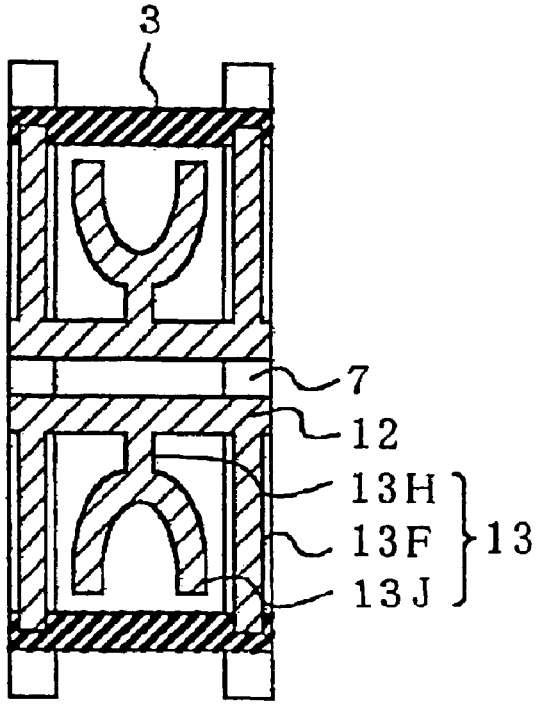
FIG. 17 is a plan view of a plasma display panel in accordance with a variant of the sixth embodiment of the present invention.
Figure 18:
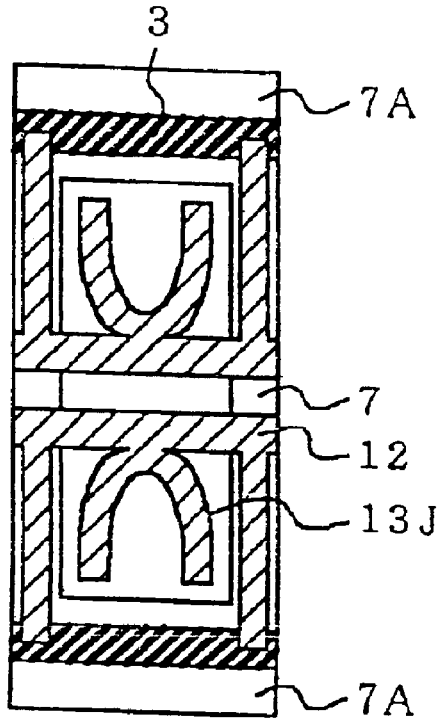
FIG. 18 is a plan view of a plasma display panel in accordance with the seventh embodiment of the present invention.

FIG. 17 is a plan view of a variant of the principal discharge electrodes illustrated in FIG. 16.

It is not necessary for the second portion 13 to be connected to the bus electrode 3, because the second portion 13 is connected to the first portion 12 which is connected to the bus electrode through the electrode 13F. Hence, as illustrated in FIG. 17, the second portion 13 may be spaced away from the bus electrode 3.

[Seventh Embodiment]

FIG. 17 is a plan view of principal discharge electrodes in a plasma display panel in accordance with the seventh embodiment.

The principal discharge electrode 2 in the seventh embodiment is comprised of a first portion 12 being in the form of a line extending in the row direction and defining a discharge gap 11 between itself and an adjacent principal discharge electrode, and a second portion 13 comprised of a U-shaped portion 13J making contact at a bottom thereof with the first portion, and an electrode 13F extending in the column direction above the partition walls 7 and electrically connecting the first portion 12 and the bus electrode 3 to each other.

In the previously mentioned embodiments, the partition walls 7 are designed to extend only in the column direction. In the seventh embodiment, the plasma display panel is designed to include second partition walls 7A extending in the row direction. Hence, the partition walls 7 and the second partition walls 7A are arranged in a matrix and cooperate with each other to define display cells.

The bus electrodes 3 may be formed in alignment with the second partition walls 7A such that the bus electrodes 3 are not exposed to a discharge space.

In the seventh embodiment, discharge is born at the first portion 12 and expands to the second portion 13, and it is possible to prevent generation of discharge in the vicinity of the second partition walls 7A.

If discharge is generated in the vicinity of the partition walls 7, electric charges generated by the discharge are attracted to the partition walls 7, resulting in that discharge is difficult to expand and ultra-violet rays are generated at a low rate. Hence, a light-emission rate is deteriorated.

In accordance with the seventh embodiment, the principal discharge electrode 2 does not allow discharge to be born in the vicinity of the partition walls 7 and 7A, in other words, does not generate discharge in an area in which a light-emission rate is low, ensuring enhancement in a light-emission rate.

[Eighth Embodiment]

Figure 19:
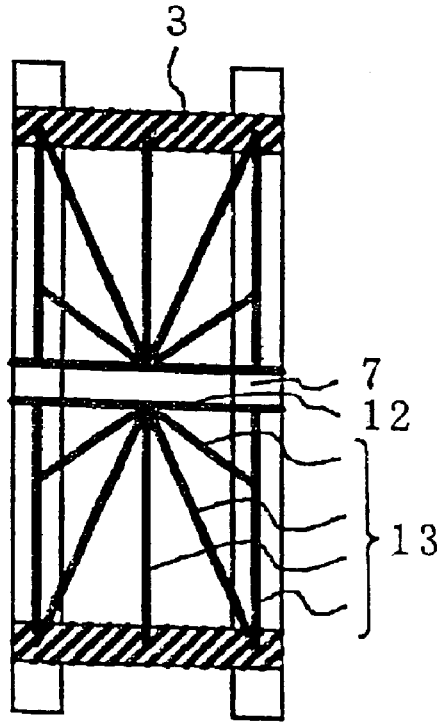
FIG. 19 is a plan view of a plasma display panel in accordance with the eighth embodiment of the present invention.

FIG. 19 is a plan view of principal discharge electrodes in a plasma display panel in accordance with the eighth embodiment.

The plasma display panel in accordance with the eighth embodiment is structurally different from the plasma display panel in accordance with the first embodiment only in a shape of the principal discharge electrode 2.

The principal discharge electrodes 2 in the previous embodiments are all comprised of a transparent electrode. In contrast, the principal discharge electrodes 2 in the eighth embodiment is comprised of a thin metal wire such as a silver wire.

Since the wires are located close to each other in the discharge gap 11, discharge is stably born, similarly to the previous embodiments.

Similarly to the previous embodiments, strong discharge born at a center of the first portion 12 in the row direction expands in the column direction along the wires.

In addition, since the wires are arranged close to one another, discharge readily expands. Since discharges are much generated in the vicinity of the partition walls 7, it is possible to prevent reduction in a luminance, and enhance a light-emission efficiency.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2002-214933 filed on Jul. 24, 2002 including specification, claims, drawings and summary is incorporated herein by reference in its entirety.

What is claimed is:

1. A plasma display panel including a first substrate, a second substrate, and discharge gas filled in a space defined between said first and second substrates, said first substrate including at least one first electrode extending in a first direction, and at least one second electrode extending in parallel with said first electrode, said second substrate including at least one third electrode extending in a second direction perpendicular to said first direction, and a plurality of partition walls extending in said second direction for partitioning a display area, wherein at least one of said first and second electrodes comprises a base portion extending in said first direction, a first portion being in the form of a line extending in said first direction and positioned apart from said base portion in said second direction, and defining a discharge gap between itself and an adjacent electrode, and a second portion continuously and radially extending from said first portion up to said base portion.

2. The plasma display panel as set forth in claim 1, wherein said second portion radially extends from said first portion at a center of said display area in said first direction.

3. The plasma display panel as set forth in claim 1, wherein said second portion is comprised of a straight line.

4. The plasma display panel as set forth in claim 1, wherein said second portion is comprised of a line including curved portions.

5. The plasma display panel as set forth in claim 1, wherein said first portion has a length measured in said first direction which length is equal to or greater than 2W wherein W indicates a width of said discharge gap.

6. The plasma display panel as set forth in claim 1, wherein said first portion has a length measured in said second direction which length is in the range of 0.5W and 3W both inclusive wherein W indicates a width of said discharge gap.

7. The plasma display panel as set forth in claim 1, wherein each of said first and second electrodes is comprised of a principal discharge electrode for carrying out discharge and a bus electrode for reducing a line resistance in said first direction.

8. The plasma display panel as set forth in claim 7, wherein said principal electrode is comprised of a transparent electrode having a high rate at which visible lights pass therethrough.

9. The plasma display panel as set forth in claim 7, wherein said principal electrode is comprised of a transparent electrode having a high rate at which visible lights pass therethrough, and a thin metal wire.

10. The plasma display panel as set forth in claim 1, wherein at least one of said first and second electrodes is comprised of a thin metal wire.

11. The plasma display panel as set forth in claim 7, wherein said principal electrode at least partially thereof does not make contact with said bus electrode in said display area.

12. The plasma display panel as set forth in claim 1, further comprising a plurality of second partition walls extending in said first direction for partitioning said display area, said first and second electrodes being arranged such that they do not extend across a boundary between said display area and said second partition walls.

13. The plasma display panel as set forth in claim 12, wherein each of said first and second electrodes is comprised of a principal discharge electrode for carrying out discharge and a bus electrode for reducing a line resistance, said bus electrode being arranged on said first partition walls such that said bus electrode is not exposed to a discharge space in said display area.

14. The plasma display panel as set forth in claim 1, wherein said second portion exists entirely in said display area.

15. The plasma display panel as set forth in claim 1, wherein said second portion is V-shaped.

16. The plasma display panel as set forth in claim 1, wherein said first portion is continuous with first portions extending in adjacent display areas.

17. The plasma display panel as set forth in claim 1, wherein said second portion is comprised of at least three lines extending from said first portion.

18. The plasma display panel as set forth in claim 17, wherein at least one of said lines exist within said display area.

19. The plasma display panel as set forth in claim 13, wherein said second electrode is at least partially connected to said bus electrode.

* * * * *